United States Patent [19]

Hsu et al.

[11] 4,081,250

[45] Mar. 28, 1978

[54] COAL DESULFURIZATION PROCESS

[75] Inventors: George C. Hsu, La Crescenta; George R. Gavalas; Partha S. Ganguli, both of Pasadena; Sarkis H. Kalfayan, La Canada, all of Calif.

[73] Assignee: California Institute of Technology, Pasadena, Calif.

[21] Appl. No.: 718,137

[22] Filed: Aug. 27, 1976

[51] Int. Cl.[2] ..... C10L 9/10; C10B 57/00

[52] U.S. Cl. ..... 44/1 R; 44/2; 201/17

[58] Field of Search ..... 44/1 R, 1 G, 2, 6, 1 B; 201/17; 208/8, 241

[56] References Cited

U.S. PATENT DOCUMENTS

| | | | |
|---|---|---|---|
| 887,145 | 5/1908 | Stoner | 201/17 |
| 2,173,842 | 9/1939 | Horner | 208/11 |
| 2,383,543 | 8/1945 | Gray | 44/6 |
| 2,453,543 | 11/1948 | Schabelitz | 44/1 B |
| 2,503,486 | 4/1950 | Himel | 208/241 X |
| 3,535,224 | 10/1970 | Corey et al. | 208/8 |
| 3,998,604 | 12/1976 | Hinkley | 44/1 R |

*Primary Examiner*—Carl F. Dees

*Attorney, Agent, or Firm*—Marvin E. Jacobs

[57] ABSTRACT

A method of chlorinolysis of coal in an organic solvent at a moderate temperature and atmospheric pressure has been proven to be effective in removing sulfur, particularly the organic sulfur, from coal. Chlorine gas is bubbled through a slurry of moist coal in chlorinated solvent. The chlorinated coal is separated, hydrolyzed and then dechlorinated. Preliminary results of treating a high sulfutr (4.77%S) bituminous coal show that up to 70% organic sulfur, 90% pyritic sulfur and 76% total sulfur can be removed. The treated coal is dechlorinated by heating at 500° C. The presence of moisture helps to remove organic sulfur.

20 Claims, 3 Drawing Figures

COAL DESULFURIZATION PROCESS

ORIGIN OF THE INVENTION

The invention described herein was made in the performance of work under a NASA contract and is subject to the provisions of Section 205 of the National Aeronautics and Space Act of 1958, Public Law 83-568 (72 Stat 435; 42 USC 2457)

BACKGROUND OF THE INVENTION

1. Field of the Invention

The present invention relates to desulfurization of coal and carbonaceous substances and, more particularly, to a low temperature process for removing sulfur from coal.

2. Description of the Prior Art

The U.S. reserve of coal is about 3 trillion tons. Although the most abundant (80%) fossil fuel in America is coal, the U.S. consumption pattern is quite a reversal of form in terms of utilization, with coal representing only 17%, oil and gas about 78%.

The demand for all the fossil fuels combined is expected to double by the year 2000, even with the increasing use of nuclear power. While the domestic supply of crude oil and natural gas is not likely to keep apace with the energy demand, coal can play an important role in filling such a gap and thus reduce the requirements for imported supplies of oil and gas.

Coal, the fossilized plant life of prehistoric times, contains various amounts of sulfur due to the nature of its origin. Under most existing commercial technology, the generation of electricity from coal poses environmental problems because of sulfur oxides and particulate emissions. Since most of the coals in this country, particularly the Eastern and Midwestern coals, have high sulfur content (>2%) there is a need for an economical process of converting high sulfur coals to clean fuel (<1.2 lbs of $SO_2$ emission per million Btu by EPA standard) to utilize coal as a source of energy without causing serious air pollution. So the need for converting massive coal reserves to clean-burning solid fuel, liquid fuel and pipeline quality gas is self evident. If the vast coal reserve is converted to clean fuel, it can supply most of the energy needs of the United States for the next three centuries.

At the present time, about one-half of the electric power in the United States is generated from natural gas and petroleum; most of the other half is from coal. If the coal is converted to clean fuel for electric utilities, petroleum and natural gas would be released for other essential uses, especially as a starting material for the synthetic rubber and plastics industry.

Sulfur in coal occurs in two types, generally in approximately equal amounts (50%): inorganic sulfur primarily as pyrites with minor amounts of sulfates and organic sulfur in the forms of thiophene, sulfide, disulfide and mercaptan chemically bound in the organic structure of coal.

The sulfur oxides in the combustion gases of coal can be removed by stack gas scrubbing methods but those are expensive processes and produce large amounts of sludge. Hydrodesulfurization processes which remove sulfur from the fuel before combustion are effective. They are used extensively in petroleum desulfurization and many coal conversion processes under development. However, they are also expensive due to the cost of hydrogen and severe operating conditions.

Physical separation methods can remove only the inorganic sulfur. Other desulfurization schemes under investigation such as TRW Meyers' process and Battelle Hydrothermal Coal Process are either primarily for inorganic sulfur removal or are operated at high temperature and pressure resulting in high process cost. Room temperature chlorinolysis of coal in aqueous media does not remove significant amounts of sulfur.

SUMMARY OF THE INVENTION

A simple method of desulfurizing coal at a moderate temperature and atmospheric pressure has been developed in accordance with this invention proceeds by the chlorinolysis of moist coal at low temperature and ambient pressure with the assistance of an organic solvent. In this method chlorine gas is bubbled through a suspension of powdered moist coal in solvent at a temperature below 120° C and atmospheric pressure for 1 to 2 hours, followed by separation, hydrolysis and dechlorination of the coal. During chlorination the pyritic and organic sulfur in coal is converted to sulfate sulfur which is then removable by leaching in water. The presence of moisture helps to remove organic sulfur. The chlorinated coal containing about 20% chlorine is leached with warm water. In this step, coal is partially hydrolyzed to give hydrochloric acid and the oxidized sulfur is dissolved in water as sulfates. The hydrolyzed coal is then dechlorinated to 0.15 to 0.3% chlorine by heating at 400° to 500° C. This dechlorinated coal is the final treated clean fuel. In chlorinolysis, the hydrogen chloride evolved during chlorination, dechlorination and hydrolysis can be recovered as a valuable byproduct or it can be converted to chlorine gas for recycle by a commercial process such as the Kel-chlor process developed by M. W. Kellogg Company.

Preliminary experimental results of treating a high sulfur bituminous coal from Hillsboro, Ill. show that up to 70% organic sulfur, 90% pyritic sulfur and 76% total sulfur can be removed. Thus a coal with 3% total sulfur can be converted to a clean fuel (<0.7% sulfur by EPA standard) for combustion or gasification. This method has also been proven to be effective for a bituminous coal from Hamilton, Ky. with high organic sulfur. Recently with some modification on this method a bituminous coal with 4.8% sulfur has been converted to a low ash fuel with 0.7% sulfur. Chlorinolysis produces improved feedstock for combustion and gasification operations as final treated coal is rendered completely noncaking and non-swelling.

The organic sulfur removal is a significant advantage of this process. Being chemically bound to the organic structure of coal this sulfur is most difficult to remove without incurring high process cost.

This desulfurization process can be used as a pretreatment step before combustion or gasification. The processing scheme is simple and compatible with current coal processing technologies. Furthermore, no feeding or filtration problems are expected.

Since this coal desulfurization process is at atmospheric pressure and mostly at low temperature the process cost is expected to be low. A preliminary cost estimate of the process including the chlorine recovery unit gives a process cost of $8 to $10 per ton of coal. The process cost of other desulfurization schemes are much higher.

These and many other features and attendance advantages of the invention will become readily apparent as the invention becomes better understood by reference to the following detailed description when considered in conjunction with the accompanying drawings.

DESCRIPTION OF THE PREFERRED EMBODIMENTS

Figures 1, 2:
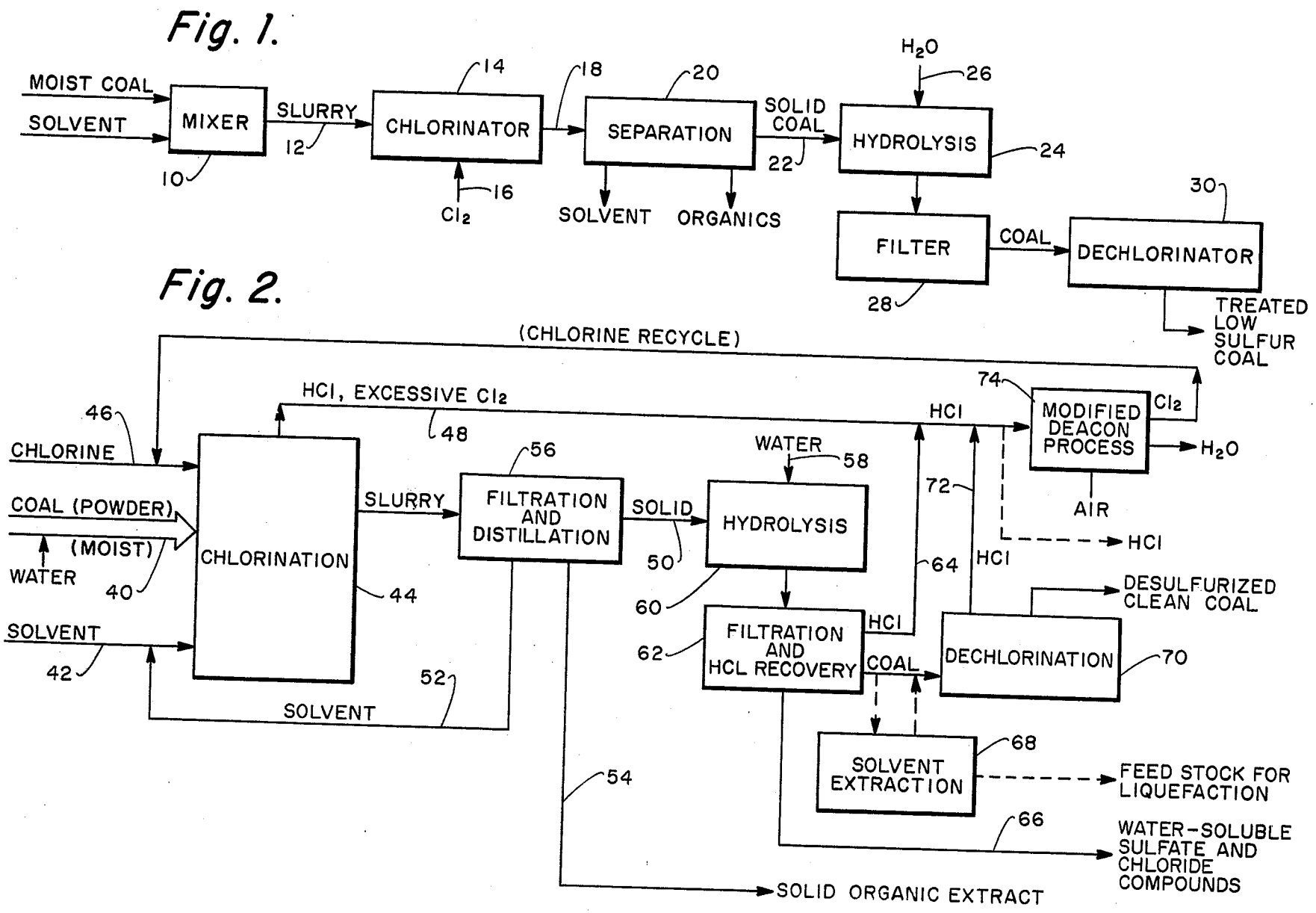
FIG. 1 is a schematic view of the coal desulfurization process according to this invention.
FIG. 2 is a flow diagram view of a coal desulfurization process with chlorine and solvent recycle.

As shown in FIG. 1, moist coal containing from 10 to 100% water based on dry coal is mixed with solvent in mixing apparatus 10 to form a slurry 12. The ratio of coal to solvent is from 5 to 50% by weight. The fine sized coal and non-aqueous solvent suspending media provide efficient access for chlorine to the coal particles in chlorinator 14. Chlorine is added, preferably continuously, through line 16. The chlorine is provided in excess and the amount added to the coal depends on the size of the coal, duration of chlorination, chlorine rate, temperature and amount of sulfur in the coal. Typically, from 10 to 50% chlorine is added to a high sulfur coal containing at least about 3% total sulfur. The chlorinated coal is delivered through line 18 to separation means 20. Solvent is removed from the coal by filtration and distillation.

Sulfur is leached from the solid, chlorinated coal 22 in hydrolysis tank 24 to which is added water through line 26. The hydrolyzed coal is filtered in filter means 28 and then dechlorinated at a temperature of from 300° to 600° C in dechlorinator 30 to yield treated low sulfur coal.

The desulfurization process is capable of desulfurizing diverse types of organic materials in addition to coal such as petroleum, oil shale or industrial wastes, particularly black liquor residues from sulfate or sulfite pulping. The coals can be anthracite, bituminous or subituminous such as lignite. Pulverization aids slurry and chlorinolysis rate. Typically, the coal will be pulverized and classified to 60 to 325 mesh usually from 100 to 200 mesh.

The organic solvent should have a low boiling point below 120° C, preferably from 40° to 100° C so that it is refluxable at or near room temperature and preferably has good resistance to consumption of chlorine. Suitable solvents are chlorinated liquid hydrocarbons such as carbon tetrachloride or methyl chloroform.

Chlorinolysis is conducted at a low temperature below 120° C preferably from ambient, e.g. 20°, to 100° C. The chlorination portion of the cycle depends on the coal size, sulfur content and temperature. High sulfur coals are chlorinated sufficiently in 1 – 2 hours at 74° C. Hydrolysis is conducted with ambient or slightly heated water, typically at a temperature of 20° to 80° C for at least 1 to 5 hours. Dechlorination can be effected to a residual chlorine content of less than 0.3% in 1–2 hours at a temperature of 400° to 600° C.

A more complete process is illustrated in FIG. 2. The process will be described in conjunction with operating parameters. Water is injected into line 40 containing powdered coal on a basis of 50 parts by weight of water to 100 parts coal. Solvent, such as methyl chloroform, is added at a level of 100 parts to 100 parts of coal through line 42 and chlorine is continuously bubbled into chlorinator 44 through line 46. Chlorination proceeds for less than 2 hours at 74° C and 1 atmosphere. The excess chlorine gas can be recycled to inlet line 46 or can leave with evolved HCl through overhead line 49.

The slurry is separated in filtration and distillation unit 56 into a solid chlorinated coal fraction 50, a solvent fraction 52 which is recycled to solvent inlet 42 and a solid organic extract containing sulfur 54 which can be recovered, but is preferably added to solid coal 50.

The chlorinated solid coal 50 is treated for less than 2 hours with water 58 at 25°–80° C in hydrolysis tank 60 to leach the aqueous soluble sulfates from the coal and then delivered to filtration unit 62. HCl from unit 62 is delivered to line 48 by line 64. Water soluble sulfate and chloride compounds are recovered through line 66. The hydrolyzed, desulfurized coal may optionally be solvent extracted in extractor 68 to yield a feedstock suitable for liquefaction or is delivered to dechlorinator 70.

Dechlorination at 400°–500° C and 1 atmosphere for less than 2 hours yields a desulfurized clean coal (<0.7%S). The gases 72 evolved from the dechlorinator are mainly HCl. The HCl can be converted to chlorine in converter 74, such as modified Deacon process (Kel-chlor process) and the chlorine recycled to inlet line 46.

Example of practice follow:

EXAMPLE 1

In these experiments chlorine gas is bubbled through a suspension of powdered moist high sulfur coal in methyl chloroform at 74° C and atmospheric pressure for 1 to 4 hours. Methyl chloroform was chosen because it is an economical non-hazardous industrial solvent which cannot be further chlorinated and has suitable normal boiling point of 74° C. The slurry is filtered and the filtrate is distilled for solvent recovery. The chlorinated coal is hydrolyzed with water at 25° C, and the slurry is filtered. The hydrolyzed chlorinated coal is dechlorinated by heating at 300°–350° C and atmospheric pressure.

A first set experiments were conducted with a high sulfur bituminous coal from Hillsboro, Ill. The moisture content in the powdered coal (100 to + 150 mesh) was varied from 0 to 50% with respect to coal. Samples were collected at ½ hr., 1 hr., 2 hrs., 3 hrs., and 4 hrs. period. The chlorinated coal was then hydrolyzed and treated coal samples were analyzed mainly for sulfur forms and chlorine. To find the effect of $AlCl_3$ as catalyst on organic sulfur removal, a similar experiment was conducted by adding 0.5% $AlCl_3$ with respect to coal. A second set of chlorinolysis experiments were carried out with a powdered (200 mesh) moist (30% moisture) bituminous coal wit high organic sulfur from Hamilton, Ky. The desulfurization results are presented in Table II.

Table 1

| Reaction Conditions | Composition | (Hillsboro) Raw Coal | Percent Sulfur Removal (Chlorine free basis) | Final Treated Coal |
|---|---|---|---|---|
| Chlorination: 74° C 1 atm, 1 hr Powdered (−100 to 150 mesh) | Pyritic sulfur | 1.89% | 77 | 0.43% |
| Moist | Organic sulfur | 2.38% | 70 | 0.72% |

Table 1-continued

| Reaction Conditions | Composition | (Hillsboro) Raw Coal | Percent Sulfur Removal (Chlorine free basis) | Final Treated Coal |
|---|---|---|---|---|
| (50%) moisture) Coal in methyl chloroform | Sulfate sulfur | 0.50% | 30 | —** |
| | Total sulfur | 4.77% | 69 | 1.15% |
| Before dechlorination | Chlorine | | | 11% |
| Dechlorination: At 500° C for 2 hrs., chlorine | | | | 0.15–0.30% |
| At 300° C for 1 hr. Chlorine | | | | 2.6% |

**Sulfate sulfur can be removed in the hydrolysis step.

Table 2 (Hamilton)

| Chlorination Conditions | Composition | Raw Coal | Final-Treated Coal | Percent Sulfur Removal |
|---|---|---|---|---|
| 74° C, 1 atm, 4 hrs | Pyritic sulfur | 0.08% | 0.03% | 62.5% |
| Powdered (−200 mesh) | Organic sulfur | 2.67%* | 1.16% 56.5% | |
| Moist (30% moisture) Coal in methyl Chloroform | Sulfate sulfur | 0.15% | 0.29% | —** |
| | Total sulfur | 2.90% | 1.48% | 59.0% |

*Sulfur in this coal is mostly organic sulfur.
**Sulfate sulfur can be removed in the hydrolysis step.

Table 1 shows that chlorinolysis of the coal for an hour in the presence of moisture can remove 77% of pyritic sulfur, 70% of organic sulfur, 30% of sulfate sulfur, and 69% of total sulfur. Since sulfate compounds are soluble in hot water, all the sulfate compounds would be removed by improving the hydrolysis step. Chlorinated coal had 22% chlorine before and 11% after the hydrolysis step. After hydrolysis and dechlorination at 300° C for an hour, the residual chlorine in the final treated coal was 2.6%. However, dechlorination at 500° C for 2 hours resulted in a final treated coal with 0.15 to 0.3% residual chlorine. Results of all the experiments with this coal indicate that removals of up to 70% organic sulfur, 90% pyritic sulfur, 30% sulfate sulfur, and 70% total sulfur have been achieved by current chlorinolysis procedures.

Results of a chlorinolysis experiment with 0.5% $AlCl_3$ as catalyst indicate that $AlCl_3$ does not have any noticeable effect on the removal of organic sulfur from coal. Coal contains iron compounds in the mineral matter sufficient to form about 1 to 2 percent of $FeCl_3$. This quantity would be sufficient to catalyze ironic chlorination reactions.

Results of a chlorinolysis experiment with dried coal and 0.5% $AlCl_3$ shows that only 18.5% of organic sulfur can be removed. So the presence of moisture has a significant effect on the removal of organic sulfur from coal. An optional solvent extraction step at room temperature of chlorinated coal shows that it can extract a considerable amount (20%) of organic matters from coal composition which in turn would be a desirable feed stock for liquid fuel synthesis.

Figure 3:
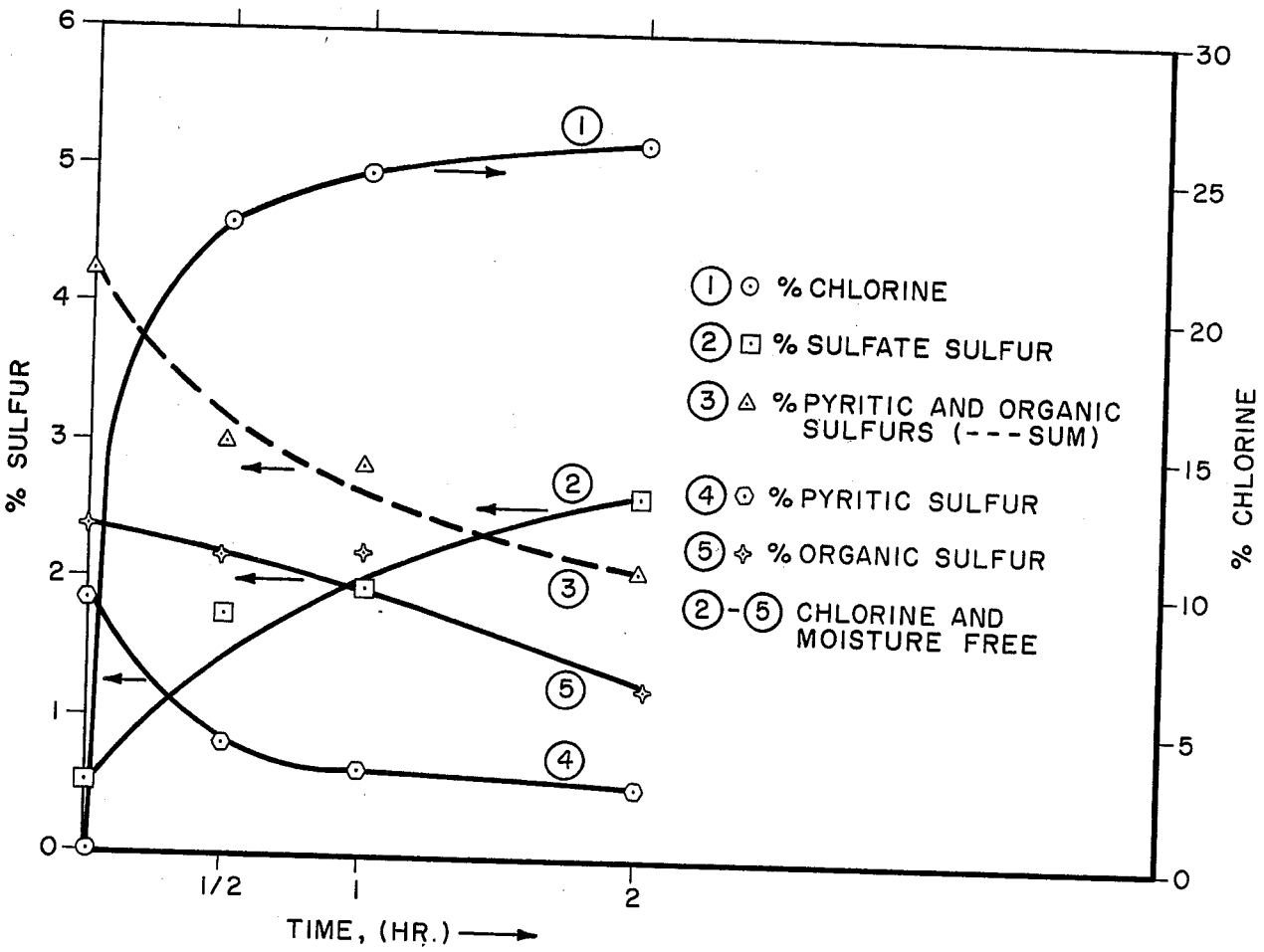
FIG. 3 is a series of graphs showing the history of sulfur and chlorine during the chlorinolysis process of the invention.

The kinetic data of chlorination and coal desulfurization are presented in FIG. 3. The initial rate of chlorination is very fast and the chlorine content in coal is 23% in half an hour and then slowly increases to 26% within the next one and a half hours. Within half an hour period most of the pyritic sulfur and a portion of organic sulfur are converted to sulfate sulfur. In the next one and a half hour period pyritic and organic sulfurs are slowly converted to sulfate sulfur. According to sulfur balance from data, the gain in sulfate sulfur is equal to the combined losses in pyritic and organic sulfurs. This result supports the possible reaction mechanisms for the conversion of pyritic and organic sulfurs to sulfate sulfur as described below.

$$FeS_2 + 2Cl_2 \rightarrow FeCl_2 + S_2Cl_2$$

$$2FeS_2 + 7Cl_2 \rightarrow 2FeCl_3 + 4SCl_2$$

$$2FeS_2 + 10SCl_2 \rightarrow 2FeCl_3 + 7S_2Cl_2.$$

$$S_2Cl_2 + 8H_2O + 5Cl_2 43\ 2H_2SO_4 + 12HCl. \text{ (FAST)}$$

$$RH + S_2Cl_2 \rightarrow RS_2Cl + HCl, \text{ where R represents a hydrocarbon group. (SLOW)}$$

Due to high steric accessibility of bicovalent S and electron releasing and electron demanding nature of S atom, the carbon-sulfur (sulfide) and sulfur-sulfur (disulfide) bonds in coal will be highly reactive. Chlorinolysis can bring about the scission of these bonds in organic compounds as follows:

$$R{-}S{-}R' + Cl^+ - Cl^- \overset{H^+}{\rightleftharpoons} RSCl + R'{+}Cl^- \rightleftharpoons RSCl + R'Cl$$

$$R{-}S{-}S{-}R' + Cl^+ - Cl^- \overset{H^+}{\rightleftharpoons} RSCl + R'S^+ + Cl^- \rightleftharpoons RSCl + R'SCl$$

Where R' and R represent hydrocarbon groups. The resulting chlorinated organo-sulfur compounds can be hydrolyzed and oxidized in the presence of chlorine at a moderately high temperature to produce sulfate compounds.

$$RSCl \xrightarrow{H_2O} RSO_2Cl \xrightarrow{\Delta, H_2O, Cl_2} RCl + SO_4^{=}.$$

Results identify that these sulfate compounds produced are remoced from coal in the hydrolysis step.

Heating value of the original coal and that of the final treated coal were 11052 Btu/lb and 10900 Btu/lb, respectively, on an as received and chlorine free basis.

Results presented in Table II show that 57% of organic sulfur can be removed by chlorinolysis of a bituminous coal with high organic sulfur.

The process of the invention has the following advantages:

(1) High degree of sulfur removal, especially the organic sulfur.

(2) Mild conditions of chlorination (74° C 1 atm.) and dechlorination (500° C, 1 atm) lead to a low cost process.

(3) Since most of the chlorine consumed by this process can be recovered as hydrogen chloride which in turn can be converted to chlorine by the Kel-chlor process, the raw material cost would be low.

(4) Chlorinolysis produces improved feedstock for direct combustion and gasification operations because the final treated coal becomes non-caking and non-swelling, or for solvent extraction since process loosens structure of coal particles.

It is to be realized that only preferred embodiments of the invention have been described and that numerous substitutions, alterations or modifications are possible without departing from the spirit or scope of the invention as defined in the claims.

What is claimed is:

1. A method of desulfurizing particulate coal comprising the steps of:

suspending the coal in an organic solvent having a boiling point below 120° C and having good resistance to consumption of chlorine to form a slurry;

chlorinating the coal by adding chlorine gas to the coal slurry at a temperature below 120° C for a time sufficient to add 10 to 50% by weight chlorine to the coal;

separating chlorinated coal from the solvent;

suspending the chlorinated coal in water and leaching water soluble sulfur compounds therefrom; and recovering chlorinated desulfurized coal.

2. A method according to claim 1 in which the organic solvent is a chlorinated liquid hydrocarbon.

3. A method according to claim 2 in which the solvent is a chlorinated aliphatic hydrocarbon.

4. A method according to claim 3 in which the solvent is methyl chloroform.

5. A method according to claim 1 in which the coal contains up to 100% by weight of moisture.

6. A method according to claim 5 in which the coal contains from 10 to 100% moisture.

7. A method according to claim 5 in which the ratio of solvent to coal is from 5 to 50% by weight.

8. A method according to claim 1 in which chlorine gas is bubbled through the coal slurry.

9. A method according to claim 8 in which the coal has a particle size from 60 to 325 mesh.

10. A method according to claim 9 in which the temperature is from 20° to 80° C and the pressure is one atmosphere during chlorinolysis.

11. A method according to claim 1 further including the step of reducing the chlorine content of the chlorinated, desulfurized coal to a chlorine content below 3% by weight.

12. A method according to claim 11 in which chlorine content reduction is effected by heating the chlorinated, desulfurized coal at a temperature from 300° to 600° C.

13. A method according to claim 11 further including the step of recovering excess chlorine and recycling it to the chlorine inlet to the chlorination step.

14. A method according to claim 13 in which excess chlorine and HCl are recovered from the chlorination step, coal recovery step and chlorine reducing step.

15. A method according to claim 1 further including the step of recycling solvent from the separation step to the inlet to the suspension step.

16. A method according to claim 15 in which separation is effected by filtration and distillation.

17. A method according to claim 1 in which leaching is effected in water at a temperature of 20° to 80° C until the residual total sulfur content is below 1.5% by weight.

18. A coal desulfurization system comprising in combination:

means for forming a suspension of coal in organic solvent to form a slurry;

chlorination means connected to the suspension means for receiving said slurry and having an inlet for bubbling chlorine gas through said slurry to form chlorinated coal;

separation means connected to the chlorination means for separating solvent from the chlorinated coal;

aqueous leaching means connected to the separation means for receiving the chlorinated coal for removing soluble sulfur compounds therefrom; and dechlorination means connected to the leaching means for receiving the leached coal and including heating means for removing chlorine from the chlorinated coal.

19. A system according to claim 10 further including means for recycling excess chlorine from the chlorination means to said inlet.

20. A system according to claim 19 further including means for recycling solvent recovered from said separation means to said suspension means.

* * * * *

UNITED STATES PATENT AND TRADEMARK OFFICE

CERTIFICATE OF CORRECTION

PATENT NO. : 4,081,250

DATED : March 28, 1978

INVENTOR(S) : George C. Hsu, George R. Gavalas, Partha S. Ganguli and Sarkis H. Kalfayan It is certified that error appears in the above-identified patent and that said Letters Patent are hereby corrected as shown below:

Column 1, line 7, change "Section 205" to -- Section 305 --.
Column 2, line 32, change "byproduct" to -- by-product --.
Column 4, line 53, correct "with".
Column 5, Table 2, move "56.5%" from "Final Treated Coal" Column to "percent Sulfur Removal" Column.
Column 5, line 51, change "ironic" to -- ionic --.
Column 6, 4th formula, change "43" to -- → --.
Column 6, in the second line of formulae, after line 25, change "R'" to -- $R'^{+}$ --.
Column 6, line 47, correct "removed".

Signed and Sealed this

*Third* Day of *October 1978*

[SEAL]

*Attest:*

RUTH C. MASON
*Attesting Officer*

DONALD W. BANNER
*Commissioner of Patents and Trademarks*